US007337915B1

(12) United States Patent
Weldon

(10) Patent No.: US 7,337,915 B1
(45) Date of Patent: Mar. 4, 2008

(54) INSULATING BEVERAGE CONTAINER HOLDER

(76) Inventor: Daniel Weldon, 3813 N. 33 rd St., Phx, AZ (US) 85018

( * ) Notice: Subject to any disclaimer, the term of this patent is extended or adjusted under 35 U.S.C. 154(b) by 0 days.

(21) Appl. No.: 11/258,251

(22) Filed: Oct. 24, 2005

Related U.S. Application Data

(63) Continuation of application No. 10/608,381, filed on Jun. 27, 2003, now abandoned.

(60) Provisional application No. 60/393,513, filed on Jul. 5, 2002.

(51) Int. Cl.

| | |
|---|---|
| ***A47J 41/00*** | (2006.01) |
| ***B65D 25/24*** | (2006.01) |
| ***B65D 81/38*** | (2006.01) |
| *B65D 23/08* | (2006.01) |

(52) U.S. Cl. ..... 220/739; 220/483; 220/592.17; 220/592.24

(58) Field of Classification Search ..... 220/483, 220/737–739, 592.17, 592.24
See application file for complete search history.

(56) References Cited

U.S. PATENT DOCUMENTS

| | | | | |
|---|---|---|---|---|
| 1,696,483 | A | 12/1928 | Hiering | |
| 2,932,119 | A | 4/1960 | Borah | |
| 3,101,566 | A * | 8/1963 | Stiller | 248/346.11 |
| 3,101,567 | A * | 8/1963 | Stiller | 248/346.11 |
| 3,149,390 | A | 9/1964 | McCoy | |
| 3,913,165 | A | 10/1975 | Behnk | |
| 4,293,015 | A * | 10/1981 | McGough | 220/739 |
| 4,759,525 | A * | 7/1988 | Cross et al. | 248/346.11 |
| 4,760,987 | A * | 8/1988 | Lan | 248/346.11 |
| D307,850 | S | 5/1990 | Aoki et al. | |
| 4,921,117 | A * | 5/1990 | Mucciarone | 220/737 |
| 5,152,709 | A * | 10/1992 | Johnson et al. | 446/71 |
| D353,975 | S | 1/1995 | Gooch | |
| 5,467,891 | A | 11/1995 | Perry | |
| 5,762,234 | A * | 6/1998 | Kiel et al. | 220/737 |
| D416,764 | S * | 11/1999 | Gagne | D7/619.1 |
| 6,000,575 | A | 12/1999 | LaCour | |
| 6,123,220 | A | 9/2000 | Williams | |
| 6,318,689 | B1 * | 11/2001 | Rodriguez | 248/311.2 |
| D453,449 | S | 2/2002 | Williams | |
| 6,464,100 | B2 | 10/2002 | Canfield | |
| 6,554,154 | B1 | 4/2003 | Chauhan et al. | |
| 6,571,976 | B1 * | 6/2003 | Sonnabend | 220/483 |
| 6,588,621 | B2 * | 7/2003 | Shimazaki | 220/592.17 |
| 6,655,543 | B2 * | 12/2003 | Beuke | 220/739 |
| 6,796,670 | B2 * | 9/2004 | Winters et al. | 362/34 |
| 6,808,090 | B2 * | 10/2004 | Pedersen | 222/181.3 |

* cited by examiner

*Primary Examiner*—Anthony D. Stashick
*Assistant Examiner*—Niki M. Eloshway
(74) *Attorney, Agent, or Firm*—Schmeiser, Olsen & Watts LLP

(57) ABSTRACT

A holder for a beverage container wherein the insulating sleeve includes internal ribs proximate to the top and bottom for gripping the container. An inwardly extending flange at the bottom of the sleeve is provided with a plurality of suction cups for stable affixation to a support surface.

19 Claims, 2 Drawing Sheets

INSULATING BEVERAGE CONTAINER HOLDER

CROSS REFERENCE TO RELATED APPLICATION

This application is a continuation of the earlier patent application by Daniel J. Weldon entitled "INSULATING BEVERAGE CONTAINER ABSTRACT", Ser. No. 10/608,381, filed Jun. 27, 2003, now abandoned, which claims priority benefit of U.S. Provisional Patent Application Ser. No. 60/393,513 filed Jul. 5, 2002, the disclosures of which are hereby incorporated herein by reference.

BACKGROUND OF THE INVENTION

This invention relates to an insulating beverage container for affixation to an adjacent surface and, in particular, to an insulating container having internal ribs for gripping a container placed therein.

The increasing use of pleasure boats and recreational off-road vehicles has generated increasing interest in accessories which enable the participant to engage in multiple activities while enjoying the outdoors. In particular, the ability to provide a stable beverage container holder that maintains the initial temperature of the beverage container over an extended period is a much desired accessory. A variety of different designs for the holders of beverage containers is found in the prior art.

One-type of holder exemplified by the device shown in U.S. DES. 417,593 to Ruegg is a straight-sided receiving sleeve having a sealing ring at the top or open end and a stabilizing foot at the closed end. The holder does not provide a means for affixation to a support surface so that it is capable of movement as the angle of the surface changes.

Another type of beverage container is disclosed in U.S. Pat. No. 6,005,752 to LaCour et al. wherein a hard plastic straight-sided receptacle is provided with a concave bottom having a number of stabilizing feet. A suction cup is located in the concave bottom. This type of container relies on a single large area suction cup to secure the container to the surface. Since receiving surfaces are frequently not uniform, the use of a single suction cup is limited in securing the container to the adjacent surface. An attempt to provide a beverage container holder that remains upright during movement or tilting of the surface is shown in U.S. Pat. No. 5,180,132 to Pearson et al. wherein a flexible suction cup is attached to the base of the container. As the attitude of the surface changes, the suction cup which has a diameter greater than that of a holder flexes without being released from the adjacent surface. This type of container is useful only in connection with uniform surfaces.

To overcome the limitations of a single suction cup provided at the base of a beverage container holder, the use of a plurality of small suction cups attached to a rigid sleeve is disclosed in U.S. Pat. No. 6,123,220 to Williams. A bottom plate that contains a number of small suction cups is affixed thereto. The body of the rigid sleeve is generally cylindrical with outwardly angled upwardly extending sidewalls to provide clearance between the holder and a beverage container placed therein. The sidewalls of the holder do not contact the container. Consequently, the holder is not insulating. The combination of a solid base and outwardly angled sidewalls maintain any spillage within the holder.

Accordingly, the present invention is directed to a receptacle for a beverage container which is both insulating for the container and exhibits stability when attached to an underlying surface. In addition to the insulating feature of the holder, an opening is provided in the base of the holder to facilitate removal of the beverage container.

SUMMARY OF THE INVENTION

The present invention is directed to a novel insulating receptacle for a beverage container wherein a flexible insulating sleeve is provided with spaced peripheral gripping members for engaging an inserted beverage container.

The gripping members form internal ribs on the sleeve and engage the container proximate to the top and bottom of the sleeve. An inwardly extending flange is located at the bottom end of the sleeve and provides the support base for a plurality of suction cups. The suction cups are circumferentially distributed about an opening bounded by the flange.

The sleeve has a first or top opening dimensioned to receive a beverage container. The container is urged into the sleeve past the spaced insulating ribs to rest against the flange located at the bottom of the sleeve. The insulating ribs contact the exterior surface of the container. The region of the sleeve intermediate the ribs is spaced from the surface of the container and forms a bounded region which is sealed off from the external environment. The insulating benefits of the sleeve and spaced ribs serve to maintain the initial temperature of the container and its contents.

By utilizing the spaced rib construction, the insertion and removal of the container is facilitated since the frictional force to be overcome is substantially reduced. In addition, location of a second opening at the bottom end of the sleeve prevents a suction force from rendering extraction difficult. The user can use the second opening to access the bottom of the container to further facilitate the removal thereof from the insulating holder.

The distribution of the plurality of suction cups about the flange provides stability when the holder is secured to an uneven surface. In other embodiments, suction cups are placed on the external surface of the sleeve to permit attachment to vertical surfaces.

Further features and advantages of the invention will become more readily apparent 5 from the following description of a preferred embodiment as shown in the accompanying drawings.

DESCRIPTION OF THE PREFERRED EMBODIMENT

Figure 1:
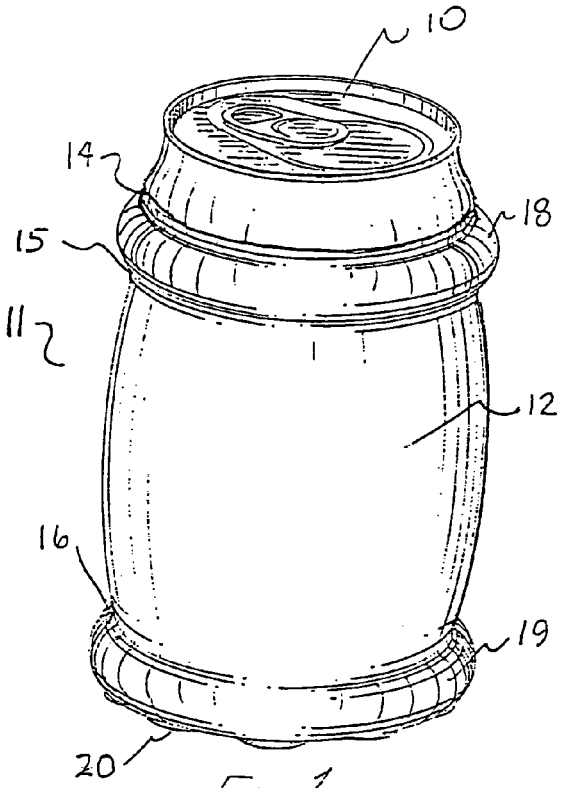
FIG. 1 is a view in perspective of a preferred embodiment of the invention showing a 10 beverage container therein.
Figure 4:
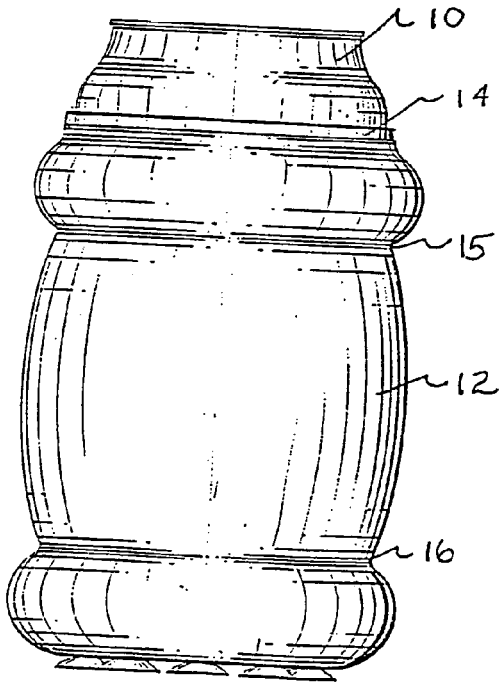
FIG. 4 is a side view of the embodiment shown in FIG. 1.

Referring now to the accompanying drawings, the preferred embodiment of the subject invention is shown in FIGS. 1 and 4 with a typical beverage container 10 placed therein. The insulating receptacle for container 10 includes a sleeve 11 formed of a flexible insulating material having a top opening dimensioned to conformably receive a beverage container height less than that of the standard beverage container.

As shown in the side view of FIG. 4, the sleeve 11 is provided with a rounded or convex protrusion 18 proximate to the top opening. A band 14 bounding the top opening is located above the protrusion 18 and a generally concave region 15 is located below the protrusion. The band 14 is preferably formed as a relatively thin band when compared with the thickness of the remaining portions of the sleeve to facilitate the insertion of the container. The generally concave section 15 adjacent the rounded protrusion 18 provides a peripheral gripping member on the internal surface of the sleeve. The gripping member 30 shown in FIG. 5 contacts the beverage container placed in the insulating receptacle.

Figure 5:
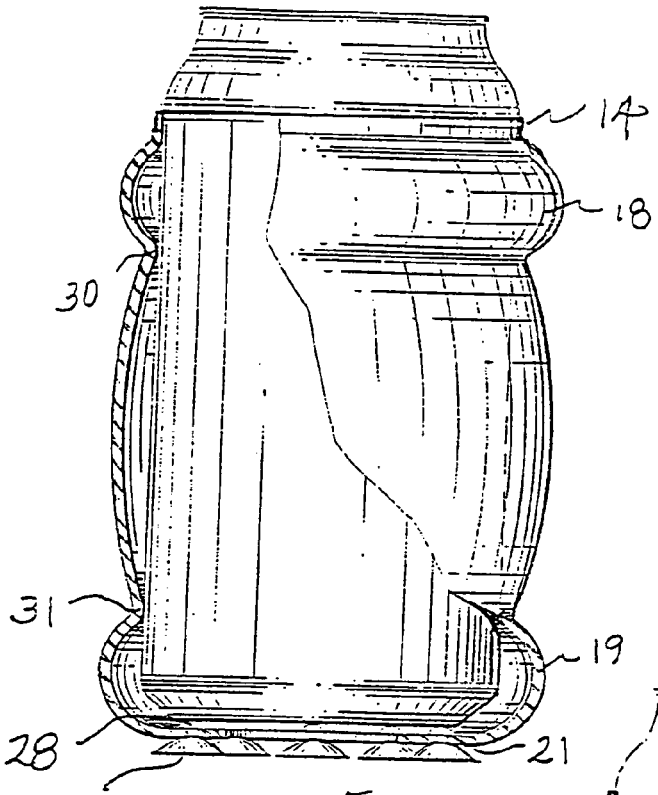
FIG. 5 is a partial sectional view of the embodiment shown in FIG. 5.

The central section 12 of the sleeve is barrel-shaped and terminates at a lower generally concave section 16 which provides another peripheral gripping member 31 shown in FIG. 5 on the internal surface of the sleeve. The central section 12 of the flexible sleeve is bowed outwardly has a first girth greater than a second girth defined by the concave sections 15 and 16, as shown in FIGS. 1 and 4. Thus, the central section 12 is not in contact with the beverage container except when depressed by the grip of the user. The region between the peripheral gripping members is not in communication with the external environment when a container is located in the insulating receptacle thereby aiding in maintaining the container temperature over an extended period.

Figure 2:
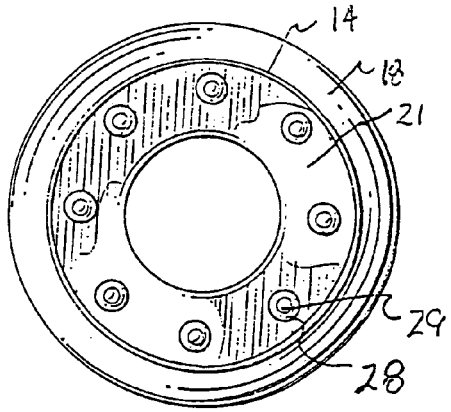
FIG. 2 is a top view of the embodiment of FIG. 1 with the beverage container removed.
Figure 3:
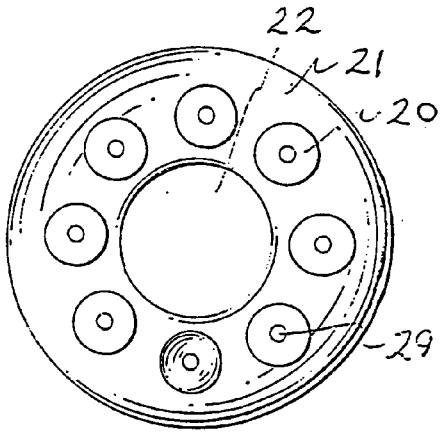
FIG. 3 is a bottom view of the embodiment of FIG. 1.

A second convex protrusion 19 is formed in the sleeve adjacent to concave section 16 and is provided with an inwardly extending flange 21 shown in FIGS. 2 and 3. The flange 21 contains a central opening 22 and has a plurality of small suction cups 20 affixed thereto. The suction cups 20 are placed in a circular pattern. The use of multiple small suction cups enables the receptacle to be attached to smaller surface areas having surface irregularities thereon and permits a central opening 22 in the bottom of the receptacle.

The suction cups have a central stem 29 which is inserted into and extends through corresponding apertures in the flange 21. As seen in FIG. 2, the central stem of each suction cup is secured by a bonding agent 28 on the inside of the flange. The bonding agent contacts the central stem and adjacent portion of the flange.

The preferred embodiment is formed of a flexible insulating material typically a single molded article. The wall thickness is uniform with the exception of the thin gripping wall bounding the top opening. The limited contact between the ribs of the sleeve and the beverage container render insertion and extraction as easy tasks, especially when the central opening has eliminated any suction force during extraction. The central opening permits a finger assist to be used during extraction.

Figure 6:
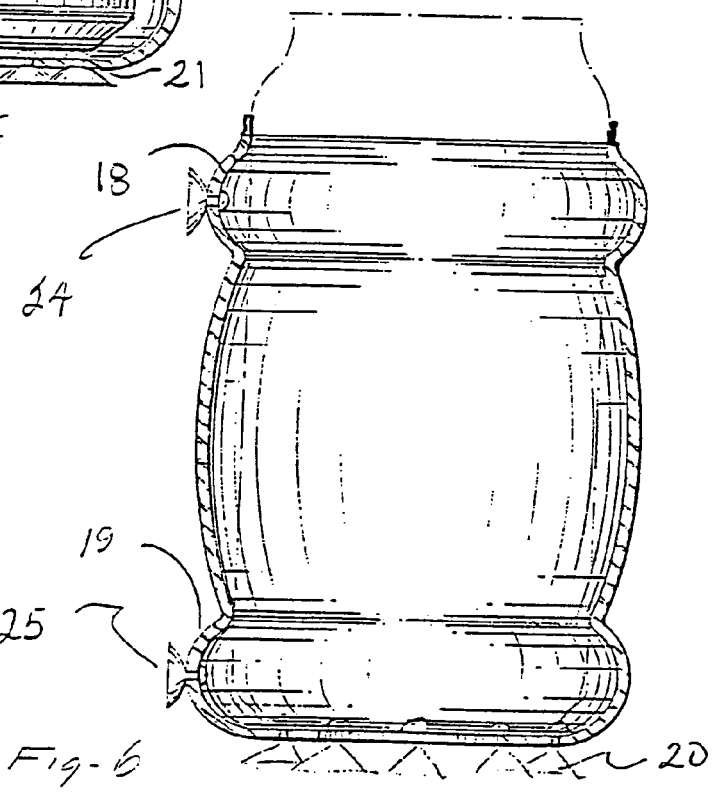
FIG. 6 is a side view of a second embodiment of the invention.

Another embodiment of the invention is shown in FIG. 6 wherein side-mounted suction cups 24 and 25 are mounted on the side of the receptacle at convex protuberances 18 and 19 respectively. The use of two side cups allows the combination of empty container and the subject holder to be stowed in and out of the place. A second suction cup can be placed adjacent to suction cup 24 for embodiments which are intended to be attached to a side wall during use.

While the above description has referred to a specific embodiment of the invention, it is to be noted that modifications and variations may be made therein without departing from the scope of the invention as set forth in the accompanying claims.

What is claimed is:

1. An insulating receptacle for a beverage container which comprises:

a) an insulating sleeve having an interior surface with a first girth, the insulating sleeve having first and second ends, said first end having a first opening dimensioned to conformably receive a beverage container therein, said second end including a second opening therein;

b) first and second inwardly extending ribs each having a second girth smaller than the first girth, the inwardly extending ribs formed integrally with said sleeve and configured for sealingly engaging an outer surface of a beverage container, wherein:

the first and second ribs are adjacently spaced from the first and second openings with no other inwardly extending ribs between the first and second fibs; and the first and second inwardly extending ribs are first and second peripheral gripping members formed in said sleeve and having the second girth for sealingly engaging a beverage container placed in said sleeve;

(c) a third peripheral gripping member formed in said sleeve, the third peripheral gripping member located at the first end;

(d) an inwardly extending flexible flange formed integrally with said sleeve at the second end thereof and bounding the second opening;

(e) a plurality of suction cups affixed to the inwardly extending flange, wherein the suction cups have a diameter that is substantially three sixteenths of an outer diameter of the sleeve, wherein said sleeve and gripping members are formed of a single layer of a single piece of flexible insulating material.

2. The insulating receptacle of claim 1 wherein the number of suction cups in the plurality of suction cups is eight.

3. The insulating receptacle of claim 1 wherein at least one additional suction cup is adjacently spaced from each of the first and second inwardly extending ribs.

4. The insulating receptacle of claim 1 wherein said sleeve contains a plurality of apertures, and said suction cups each include a stem inserted into an aperture.

5. A method of supporting and insulating a beverage, comprising:

engaging a beverage container by a plurality of annular gripping members on an interior of an insulating beverage receptacle comprising a one piece sleeve of flexible material and a top opening dimensioned to conformably receive the beverage container, wherein the step of engaging comprises:

spacing a majority of the insulating beverage receptacle from the beverage container by engaging the beverage container only on a minor portion of the beverage container;

sealingly engaging the beverage container and firmly gripping the beverage container against inadvertent separation of the beverage container from the insulating beverage receptacle;

removably attaching the beverage container and the insulating beverage receptacle to a surface by a plurality of suction cups attached to the insulating beverage receptacle; wherein the step of removably attaching further comprises:

making removal of the beverage container with the insulating beverage receptacle difficult when a force is applied in a vertical direction; and making removal of the beverage container with the insulating beverage receptacle easy by a force that is applied in a direction transverse to the vertical direction.

6. The method of claim 5, wherein the step of removably attaching the beverage container and the insulating beverage receptacle further comprises holding the attached insulating beverage receptacle in an attached state on a surface having irregularities by using multiple small suction cups.

7. The method of claim 5, wherein the step of firmly gripping the beverage container further comprises rendering insertion and extraction easy by limited contact between the insulating beverage receptacle and the beverage container.

8. The method of claim 7, wherein the steps of firmly gripping the beverage container and rendering insertion and extraction easy further comprises engaging the beverage container with one of said gripping members comprising a band bounding said top opening of the insulating beverage receptacle, wherein the band is thin relative to a remainder of the insulating beverage receptacle.

9. The method of claim 5, further comprising removing the beverage container from the receptacle by accessing a bottom of the beverage container through an opening in a bottom of the insulating beverage receptacle.

10. An insulating receptacle for a beverage container which comprises:

a) an insulating sleeve having first and second ends, said first end having a first opening dimensioned to conformably receive a beverage container therein, and said second end having a second opening;

b) at least first and second inwardly extending annular gripping members on an interior of the sleeve configured for sealingly engaging said beverage container and for defining a volume of air bounded by said first and second inwardly extending annular gripping members, said beverage container and an interior surface of said insulating sleeve;

c) a flexible flange formed integrally with said sleeve at the second end thereof and bounding said second opening; and d) a plurality of suction cups affixed to the flange, wherein said sleeve and gripping members are formed of a single layer of a single piece of flexible insulating material.

11. The insulating receptacle of claim 10 further comprising a third annular gripping member formed in said sleeve, one of said gripping members being located at said first end.

12. The insulating receptacle of claim 10 wherein two of the gripping members are ribs formed in said sleeve.

13. The insulating receptacle of claim 10 wherein said ribs are adjacently spaced from the first and second openings.

14. The insulating receptacle of claim 10 wherein:

the flexible flange extends inwardly from the second end bounds the second opening;

the flange contains a plurality of apertures spaced about the second opening; and said suction cups each include a stem inserted into one of the plurality of apertures.

15. The insulating receptacle of claim 14 further comprising a bonding agent applied to the stem of the suctions cups.

16. The insulating receptacle of claim 10 further comprising a side-mounted suction cup.

17. The insulating receptacle of claim 10 wherein the sleeve includes a central section between the first and second inwardly extending annular gripping members, the central section being moveable between a position towards the container and a position bowed outwardly from the container.

18. An insulating receptacle for a beverage container which comprises:

a) an insulating sleeve having an interior surface with a first girth, the insulating sleeve having first and second ends, said first end having a first opening dimensioned to conformably receive a beverage container therein, said second end including a second opening therein;

b) first and second inwardly extending ribs each having a second girth smaller than the first girth, the inwardly extending ribs formed integrally with said sleeve and configured for sealingly engaging an outer surface of a beverage container, wherein:

the first and second ribs are adjacently spaced from the first and second openings with no other inwardly extending ribs between the first and second fibs; and the first and second inwardly extending ribs are first and second peripheral gripping members formed in said sleeve and having the second girth for sealingly engaging a beverage container placed in said sleeve;

(c) a third peripheral gripping member formed in said sleeve, the third peripheral gripping member located at the first end;

(d) an inwardly extending flexible flange formed integrally with said sleeve at the second end thereof and bounding the second opening;

(e) a plurality of suction cups affixed to the inwardly extending flange, wherein the suction cups have a diameter that is substantially three sixteenths of an outer diameter of the sleeve, wherein said insulating receptacle has a wall thickness which is uniform except at the third peripheral gripping member.

19. The insulating receptacle of claim 18 wherein said sleeve is formed of one piece of flexible insulating material.

* * * * *

UNITED STATES PATENT AND TRADEMARK OFFICE

CERTIFICATE OF CORRECTION

PATENT NO. : 7,337,915 B1
APPLICATION NO. : 11/258251
DATED : March 4, 2008
INVENTOR(S) : Daniel Weldon It is certified that error appears in the above-identified patent and that said Letters Patent is hereby corrected as shown below:

Col. 4 line 16 should read --...between the first and second ribs;--

Col. 6 line 30 should read --...between the first and second ribs;--

Signed and Sealed this

Twenty-sixth Day of August, 2008

JON W. DUDAS
*Director of the United States Patent and Trademark Office*